US007530834B2

(12) United States Patent
Kuo et al.

(10) Patent No.: US 7,530,834 B2
(45) Date of Patent: May 12, 2009

(54) COVER ASSEMBLY WITH ELECTRONIC CONNECTORS

(75) Inventors: Peter Kuo, Tu-Cheng (TW); Hou-Yu Shi, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/012,851

(22) Filed: Feb. 6, 2008

(65) Prior Publication Data

US 2008/0188118 A1 Aug. 7, 2008

(30) Foreign Application Priority Data

Feb. 7, 2007 (CN) ..... 2007 2 0034633

(51) Int. Cl.
*H01R 13/62* (2006.01)

(52) U.S. Cl. ..... 439/367; 439/893

(58) Field of Classification Search ..... 439/367, 439/893, 639, 652, 653
See application file for complete search history.

(56) References Cited

U.S. PATENT DOCUMENTS

| | | | | |
|---|---|---|---|---|
| 6,208,233 | B1 * | 3/2001 | Stein et al. | 338/195 |
| 2008/0057764 | A1 * | 3/2008 | Kuo | 439/248 |
| 2008/0188117 | A1 * | 8/2008 | Kuo et al. | 439/367 |

* cited by examiner

*Primary Examiner*—Hae Moon Hyeon
(74) *Attorney, Agent, or Firm*—Wei Te Chung

(57) ABSTRACT

A cover assembly includes a cover including a first cover with a receiving space on the upper surface thereof, a main body having an installing post and connecting the bottom of the first cover, a second cover on the top of the first cover, and a securing portion including a cooperating piece, a flexible section and a latching rim extending from the flexible section in a direction perpendicular to the flexible section; wherein the second cover has a latch cavity to form a passage with an open defined in the first cover and penetrating along up-to-down direction, the cooperating piece is rotatably assembled with the installing post and the securing portion is capable of rotating around the installing post to achieve a fixed position and an engaging position on which the cooperating piece is inserted in the passage to assemble the two covers and the main body together.

15 Claims, 5 Drawing Sheets

COVER ASSEMBLY WITH ELECTRONIC CONNECTORS

BACKGROUND OF THE INVENTION

1. Field of the Invention

The present invention relates generally to a cover assembly of electronic connectors, and more particularly to a cover assembly having an improved securing portion.

2. Description of the Prior Art

At present, a part of mobile audio/video electronic devices use docking to communicate these devices with environment. The docking always comprises a few electronic connectors, wherein one of the electronic connectors connects the electronic device and others of the electronic connectors connects some mating connectors of different types. For adapting to connect different electronic devices with different kinds of electronic connectors, the docking is designed to include more than one receiving channel with different configurations. Reference to FIG. 1, a docking 100' is shown to comprise a cover assembly. The cover assembly comprises an upper cover 101', a lower cover 102' receiving the upper cover 101', a main body 103' accommodating the lower cover 102', and a securing portion 104' formed with the lower cover 102' to secure the upper cover 101' to the lower cover 102'. The securing portion 104' assembles the upper cover 101' with the lower cover 102' and the upper cover 101' can be pulled to separate from the lower cover 102' due to the securing portion's flexible transmutation. However, the securing portion 104' can not secure both the two covers with the main body 103', thus, the cover assembly needs another component to engage the covers on the main body to form a complex system.

Hence, an improved cover assembly is desired to overcome the above-mentioned shortcomings of the existing cover assembly of dockings.

BRIEF SUMMARY OF THE INVENTION

A primary object, therefore, of the present invention is to provide a cover assembly with an improved securing portion which secures all components of the cover assembly together.

In order to implement the above object and overcomes the above-identified deficiencies in the prior art, the cover assembly comprises a cover comprising a first cover with a receiving space on the upper surface thereof, a main body having an installing post and connecting the bottom of the first cover, a second cover on the top of the first cover, and a securing portion comprising a cooperating piece, a flexible section and a latching rim extending from the flexible section in a direction perpendicular to the flexible section; wherein the second cover has a latch cavity to form a passage with an open defined in the first cover and penetrating along up-to-down direction, the cooperating piece is rotatably assembled with the installing post and the securing portion is capable of rotating around the installing post to achieve a fixed position and an engaging position on which the cooperating piece is inserted in the passage to assemble the two covers and the main body together.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
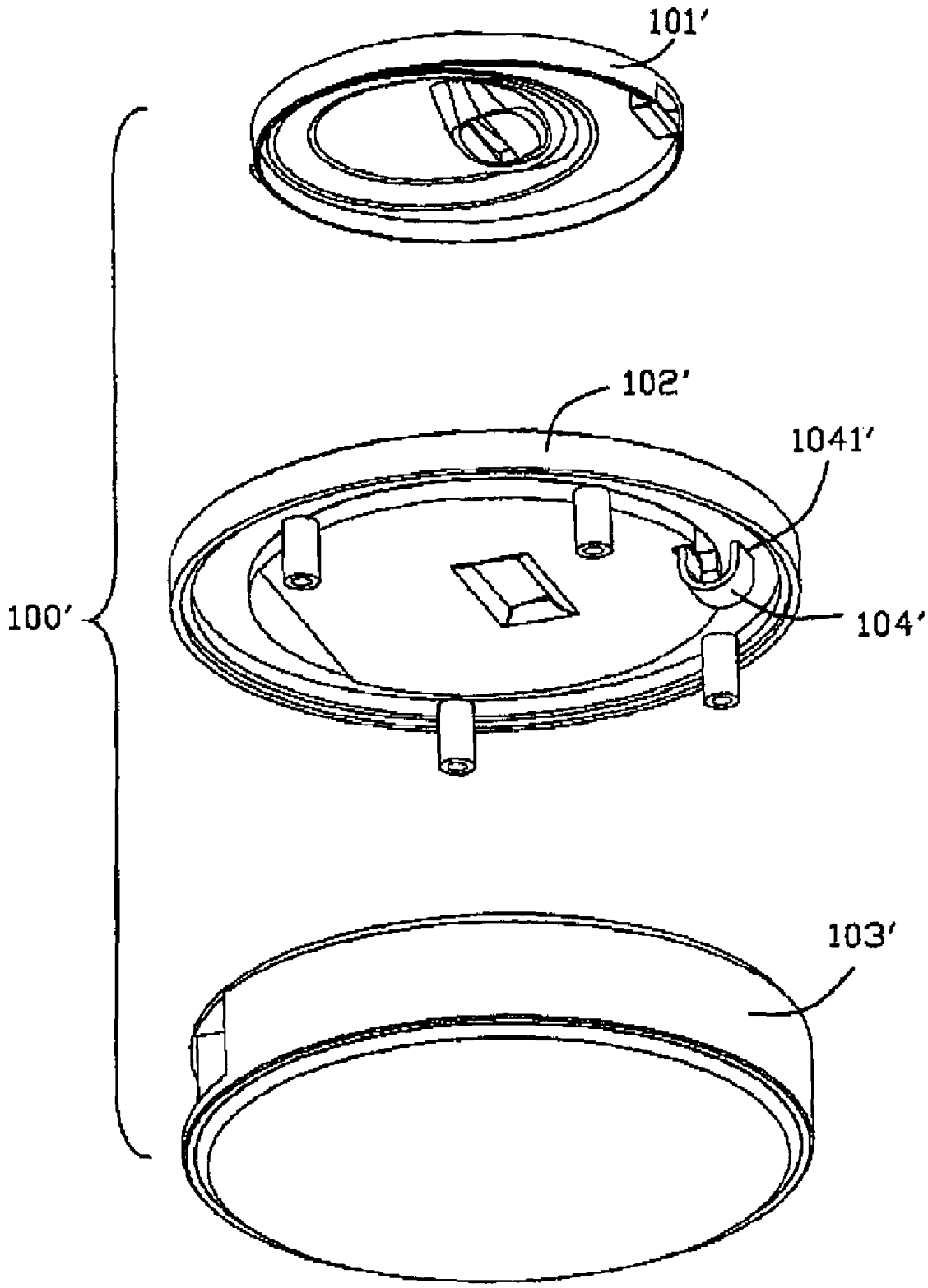
FIG. 1 (PRIOR ART)
FIG. 1 is a perspective view illustrating a conventional cover assembly.
Figure 2:
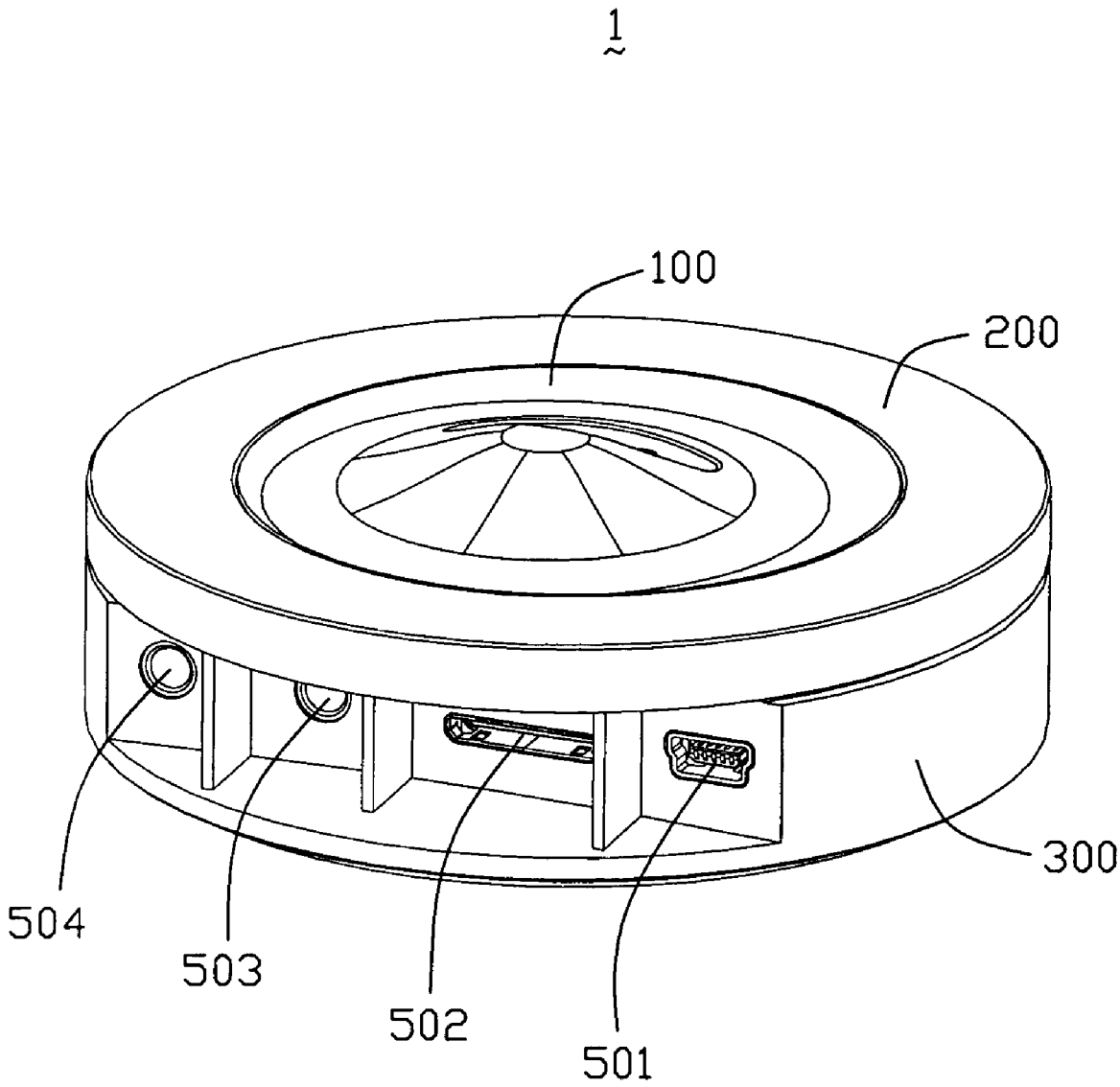
FIG. 2 is a perspective view illustrating a preferred embodiment of a cover assembly of the present invention assembled with electronic connectors.
Figure 3:
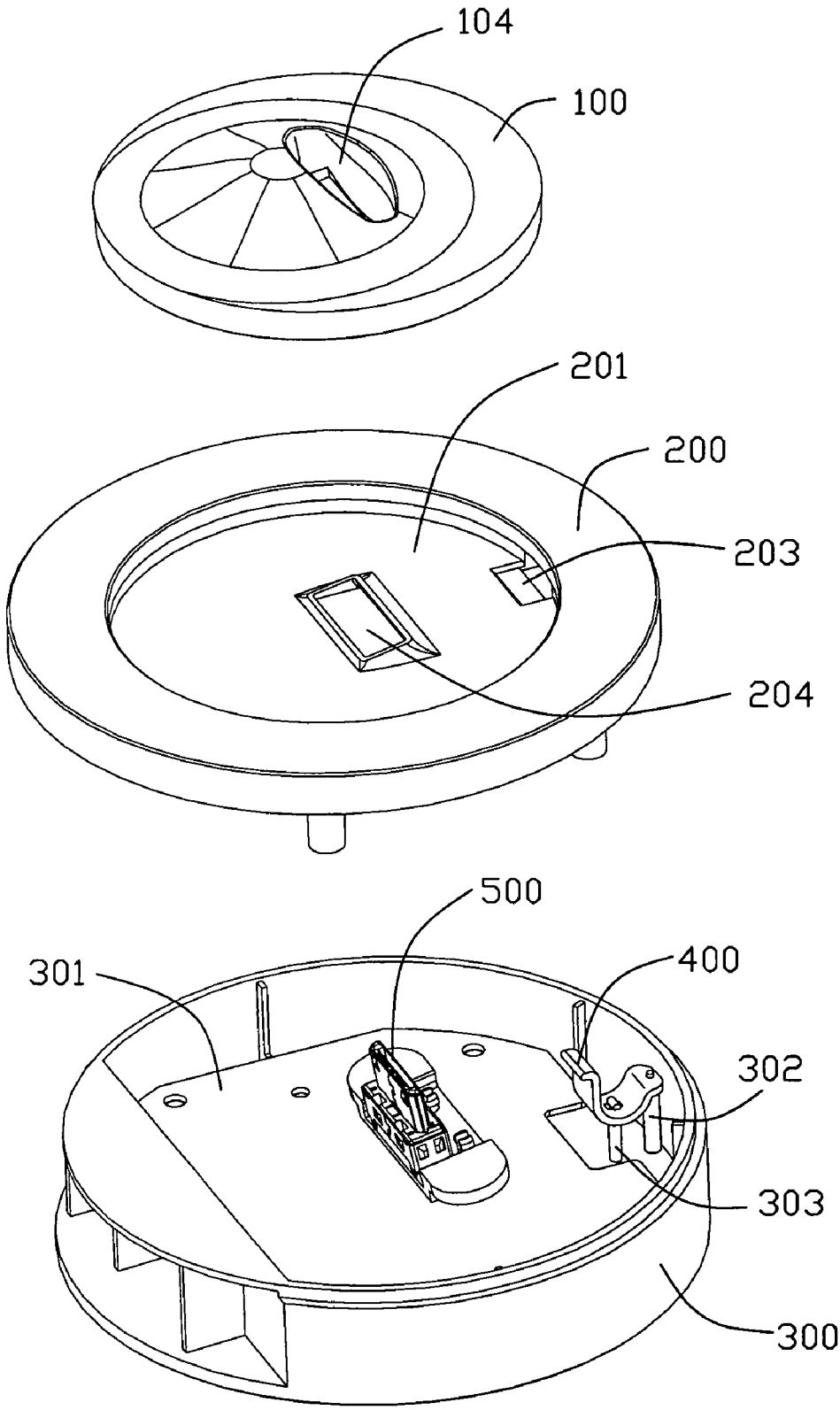
FIG. 3 is a partially exploded, perspective view illustrating a preferred embodiment of a cover assembly of the present invention assembled with an electronic connector.
Figure 4:
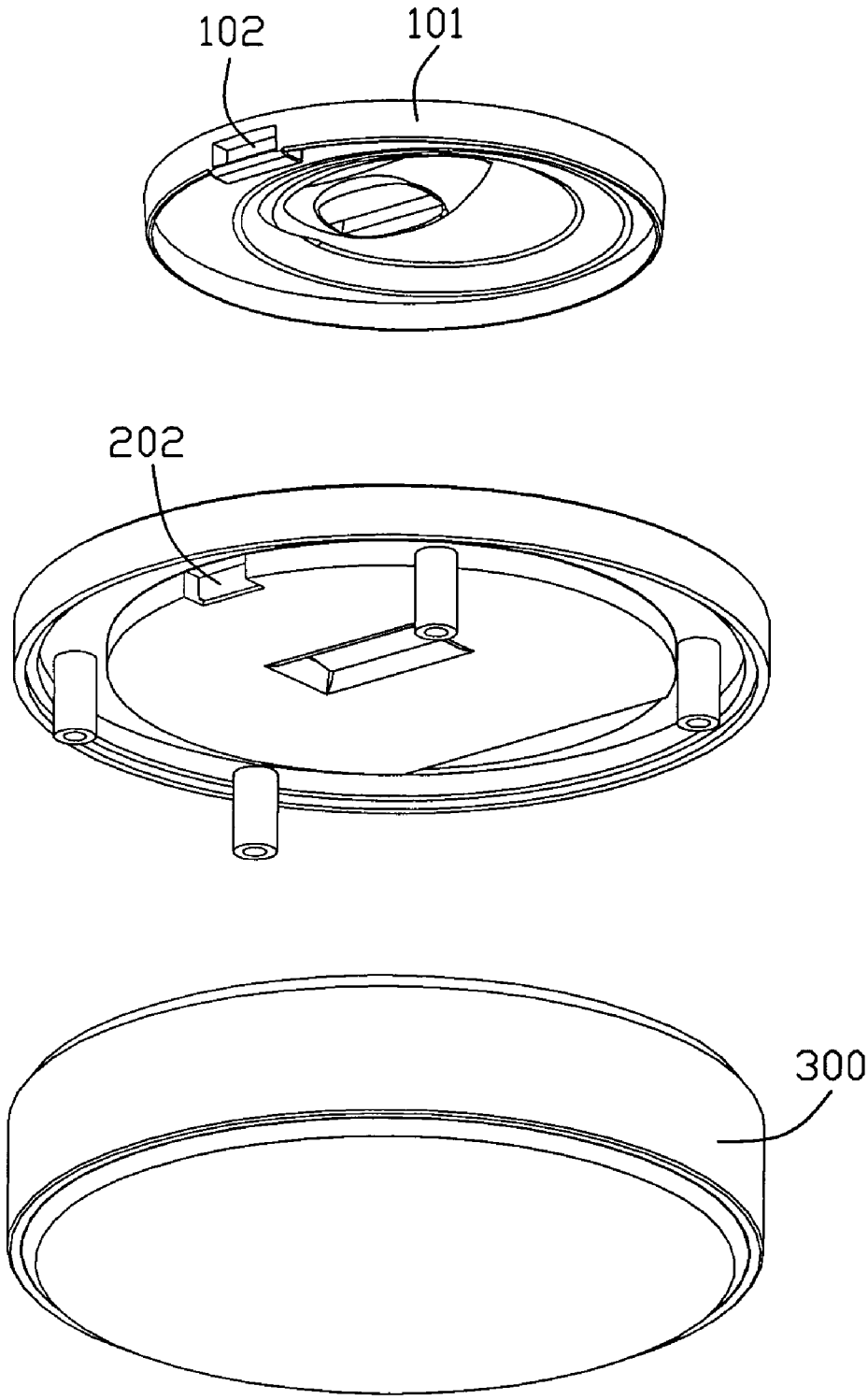
FIG. 4 is a view similar to the FIG. 3, but viewed from a different angle.
Figure 5:
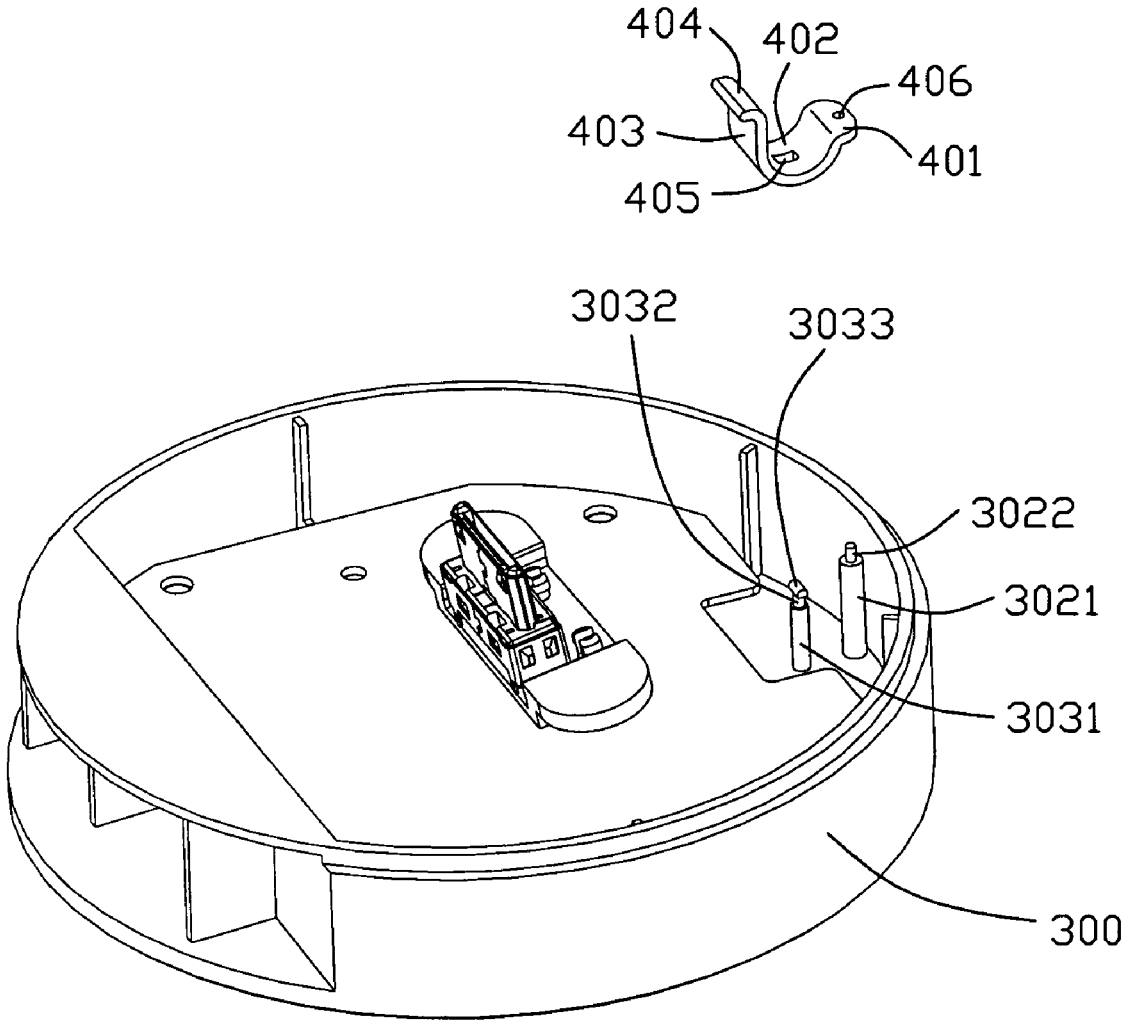
FIG. 5 is a perspective view illustrating a part of preferred embodiment of a cover assembly of the present invention assembled with an electronic connector.

Reference to FIG. 2, an assembled, perspective view of a cover assembly 1 in accordance with a preferred embodiment of the present invention is shown. FIGS. 3-4 show exploded, perspective views of FIG. 2, but viewed from different angles. And reference to FIG. 5 shows a perspective view illustrating a part of preferred embodiment of a cover connector assembly.

Reference to FIGS. 2-5, the cover assembly 1 comprises a cover (not signed), a securing portion 400, an electronic connector 500 to connect to an outer electronic device and some other electronic connectors 501, 502, 503, 504 to connect to outer mating connectors for realizing different functions. The cover comprises a main body 300, an upper cover 100 and a lower cover 200. In other embodiment, the docking can have single function such as charger, when the electronic connector 501 connects a cable to directly connect the power. To adapt to the electronic connector 500 connect different outer electronic devices, the cover which has a receiving channel to receive the outer connector comprises the upper cover 100 and the lower cover 200. The upper cover 100 has a receiving channel 104 with a shape different from a receiving channel 204 formed on the lower cover 200. The upper cover 100 is assembled on the lower cover 200 and can be pulled to be apart from the lower cover 200 if need.

In this embodiment, the upper cover 100 comprises a circumferential wall 101 and a protrusion defining a latch cavity 102 extending inward from the protrusion to open toward outside and communicate outer periphery of the circumferential wall 101. The lower cover 200 comprises a receiving space 201 to receive the upper cover 100 and an open 202 penetrating along up-to-down direction and a receiving cavity 203 formed on inner surface of the lower cover 200 to communicate with the receiving space 301 and the open 202. The protrusion of the upper cover 100 is received in the receiving cavity 203 to form a passage communicating the latch cavity 102 and the open 202. The main body 300 has a surrounding wall and a bottom to form a receiving space 301 to which the securing portion 400 and the electronic connector 500 are assembled. A fixing post 302 and an installing post 303 extend upward from the bottom of the main body 300 and the shortest distance between the fixing post 302 and the surrounding wall is shorter than the shortest distance between the installing post 303 and the surrounding wall. The fixing post 302 comprises a thin upper column section 3022 and a lower column section 3021 with larger diameter. The installing post 303 comprises a vertical lower supporting section 3031 with a relatively larger diameter, a horizontal upper semicircular section 3033 and a vertical neck section 3032 between the supporting section 3031 and the semicircular section 3033. The securing portion 400 comprises a flat fixing piece 401, an arc cooperating piece 402 defining one end connecting to the locating piece 401, a vertical flexible section 403 having an end to connect the cooperating piece 402, and a latching rim 404 extending from the other end of the flexible section 403 and substantially perpendicular to the vertical flexible section 403. The cooperating piece 402 has a rectangle engaging hole 405 on the bottom thereof, and the locating piece 401 has a fixing hole 406 in the middle thereof. The semicircular section 3033 can go through the engaging hole 405 in a certain position, and then the engaging hole 405 is rotated substantially 90 degrees, the cooperating piece 402 is fixed between the semicircular section 3033 and the supporting section 3031, that is, the cooperating piece 402 surrounds the neck section 3032. The height of the neck section 3032 is equal to the height of the cooperating piece 402, thus, the cooperating piece 402 is fixed between the semicircular section 3033 and the supporting section 3031. The thin column 3022 can be inserted in the fixing hole 406 to fix the locating piece 401 on the fixing post 302 because the lower column section 3021 has a diameter longer than the diameter of the fixing hole 406.

When the securing portion 400, the main body 300, the upper cover 100, and the lower cover 200 are assembled together, the latching rim 404 of the securing portion 400 go through the open 202 of the lower cover 200 to expose in the latch cavity 102 and latch with upper edge of the latch cavity 102 to lock the upper cover 100 and the lower cover 200, and the covers 100, 200 are fastened on the main body 300 by the join of the securing portion 400, the fixing post 302 and the installing post 303. When the upper cover 100 is pulled, the latching rim 404 could move out form the latch cavity 102 through the flexible section 403 changing its position relative to the cooperating piece 402. Thus, when the latching rim 404 moves outside the latch cavity 102, the upper cover 100 could be pulled to be apart from the lower cover 200.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cover assembly comprising:

a cover comprising a first cover with a receiving space on the upper surface thereof, a main body having an installing post and connecting the bottom of the first cover, a second cover on the top of the first cover; and a securing portion comprising a cooperating piece with an engaging hole, a flexible section and a latching rim extending from the flexible section in a direction perpendicular to the flexible section;

wherein the second cover has a latch cavity to form a passage with an open defined in the first cover and penetrating along an up-to-down direction, the cooperating piece is rotatably assembled with the installing post through the engaging hole corresponding to the installing post and the securing portion is capable of rotating around the installing post to achieve a fixed position and an engaging position on which the latching rim is inserted in the passage to assemble the two covers and the main body together.

2. The cover assembly as claimed in claim 1, wherein said securing portion also comprises a fixing piece, and the main body comprises a fixing post corresponding to the fixing piece, wherein the fixing piece has a fixing hole to receive the fixing post to fix the location of the securing portion.

3. The cover assembly as claimed in claim 2, wherein said fixing post comprises a thin upper column section and a lower column section with larger diameter, and the upper column section corresponding to the fixing hole which is blocked by the lower column section.

4. The cover assembly as claimed in claim 1, wherein said installing post comprises a vertical lower supporting section with a relatively large diameter to support the securing portion, a horizontal upper semicircular section to fix the securing portion, and a vertical neck section between the lower post and the upper column.

5. The cover assembly as claimed in claim 4, wherein said cooperating piece of the securing portion is arc and has an engaging hole on the bottom thereof.

6. The cover assembly as claimed in claim 5, wherein said semicircular section of the installing post goes through the engaging hole and the cooperating piece with the whole securing portion is fixed between the semicircular section and the supporting section.

7. The cover assembly as claimed in claim 6, wherein said the engaging hole has a length and a width corresponding to the semicircular section.

8. The cover assembly as claimed in claim 1, wherein said first cover comprises a receiving cavity on inner surface thereof to communicate with the receiving space and the open.

9. The cover assembly as claimed in claim 8, wherein said the second cover comprises a circumferential wall and a protrusion formed on the circumferential wall to define the latch cavity extending inward from the protrusion, and the protrusion is received in the receiving cavity to form said passage.

10. The cover assembly as claimed in claim 1, wherein said latching rim of the securing portion go through the open of the first cover to expose in the latch cavity of the second cover.

11. The cover assembly as claimed in claim 1, wherein said first cover is assembled on the main body and the second cover is assembled in the receiving space of the first cover.

12. The cover assembly as claimed in claim 11, wherein both said first cover and second cover comprise a receiving channel to receive different outer electronic connectors respectively, wherein the structure of the receiving channel in the first cover is different from the structure of the receiving channel in the second cover.

13. A connector assembly comprising:

a main base defining an interior space with at least one post and a plurality of connector therein, at least one connector facing upward;

a lower cover positioned upon the main base and defining a first opening in vertical alignment with said at least one connector, said lower cover further defining an upward receiving space;

an upper cover downwardly and receivably assembled into said receiving space and defining a second opening in vertical alignment with the first opening so as to cooperate with said first opening for vertical accessibility of said at least one connector;

a securing device mounted on the at least one post of the main base with a deflectable latch transversely extending through said lower cover and releasably latched to the upper cover so as to assemble the main base, the lower cover and the upper cover together.

14. The connector assembly as claimed in claim 13, wherein said deflectable latch defines an elongated engaging hole, said at least one post is equipped with a neck portion received in said engaging hole and with a semicircular section located above the neck portion to retain said deflectable latch in position with regard to said at least one post.

15. The connector assembly as claimed in claim 14, further including another post with a thin column at a top end to be received in another engaging hole of the latch.

* * * * *